US007718236B2

(12) United States Patent
Yau et al.

(10) Patent No.: US 7,718,236 B2
(45) **Date of Patent: *May 18, 2010**

(54) INKJET RECORDING ELEMENT AND METHOD

(75) Inventors: Hwei-Ling Yau, Rochester, NY (US); Wendy S. Krzemien, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 1422 days.

This patent is subject to a terminal disclaimer.

(21) Appl. No.: 10/795,836

(22) Filed: Mar. 8, 2004

(65) Prior Publication Data

US 2005/0195266 A1 Sep. 8, 2005

(51) Int. Cl.
*B41M 5/40* (2006.01)

(52) U.S. Cl. ..... 428/32.21; 428/32.26; 428/32.35; 428/32.37; 428/32.38

(58) Field of Classification Search ..... 428/32.21, 428/32.26, 32.37, 32.35, 32.38; 347/95, 347/105

See application file for complete search history.

(56) References Cited

U.S. PATENT DOCUMENTS

| | | | | |
|---|---|---|---|---|
| 4,785,313 | A | 11/1988 | Higuma et al. | |
| 4,832,984 | A | 5/1989 | Hasegawa et al. | |
| 5,789,070 | A * | 8/1998 | Shaw-Klein et al. | 428/32.24 |
| 6,013,354 | A | 1/2000 | Tomizawa et al. | |
| 6,114,020 | A | 9/2000 | Misuda et al. | |
| 6,357,871 | B1 | 3/2002 | Ashida et al. | |
| 6,632,485 | B1 * | 10/2003 | Tang et al. | 428/32.1 |
| 6,753,051 | B1 * | 6/2004 | Landry-Coltrain et al. | 428/32.36 |
| 6,861,114 | B2 * | 3/2005 | Yau et al. | 428/32.35 |
| 6,869,178 | B2 * | 3/2005 | Yau et al. | 347/105 |
| 2003/0059583 | A1 | 3/2003 | Allan | |
| 2003/0107636 | A1 * | 6/2003 | Gallo et al. | 347/105 |
| 2003/0138608 | A1 * | 7/2003 | Landry-Coltrain et al. | 428/195 |
| 2004/0023027 | A1 * | 2/2004 | Leon et al. | 428/402 |
| 2004/0090512 | A1 * | 5/2004 | Yau et al. | 347/105 |
| 2004/0090514 | A1 * | 5/2004 | Yau et al. | 347/106 |

FOREIGN PATENT DOCUMENTS

| | | |
|---|---|---|
| EP | 1160097 | 12/2001 |
| EP | 1188574 | 3/2002 |
| EP | 0858906 | 6/2002 |
| EP | 0858905 | 11/2002 |
| JP | 59-222381 | 12/1984 |

* cited by examiner

*Primary Examiner*—Betelhem Shewareged
(74) *Attorney, Agent, or Firm*—Chris P. Konkol; Arthur E. Kluegel; Andrew J. Anderson

(57) ABSTRACT

An inkjet recording element having a support having thereon in sequence (a) a transparent, non-porous layer that can be swelled by water less than 0.67 of its original weight, and (b) a fusible, porous image-receiving layer. The inkjet recording element exhibits improved adhesion and excellent image quality. A method of inkjet printing is also disclosed.

21 Claims, No Drawings

INKJET RECORDING ELEMENT AND METHOD

FIELD OF THE INVENTION

The present invention relates to a porous inkjet recording element consisting of at least two layers on a support, an outermost porous layer, containing two types of fusible polymer particles, and an underlying non-porous layer, closer to the support, having controlled and limited water swellability.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol, or mixtures thereof.

An inkjet recording element typically comprises a support having on at least one surface thereof an ink-receiving or image-receiving layer, and includes those intended for reflection viewing, which have an opaque support, and those intended for viewing by transmitted light, which have a transparent support.

A desirable characteristic of inkjet recording elements is the capability to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

Inkjet prints, prepared by printing onto inkjet recording elements, are potentially subject to environmental degradation. They are especially vulnerable to damage resulting from contact with water and atmospheric gases such as ozone. The damage resulting from post-imaging contact with water can take the form of water spots resulting from deglossing of the top coat, dye smearing due to unwanted dye diffusion, and even gross dissolution of the image recording layer. Ozone bleaches inkjet dyes resulting in loss of density.

To overcome these deficiencies inkjet prints are often laminated. However, lamination is expensive since it requires a separate roll of material. Print protection can also be provided by coating a polymer solution or dispersion onto the surface of an inkjet element after the image is formed. The aqueous coating solutions are often polymer dispersions capable of film formation when water is removed. However, due to the wide variety of surface properties, it is difficult to formulate an aqueous polymer solution to be universally compatible to all inkjet receivers.

Numerous publications teach the concept of fusible organic particles as an overcoat layer of a inkjet recoding media in order to achieve fast ink absorption before fusing and image protection after fusing.

For example, EP 0858905 discloses the preparation of a recording medium comprising a porous outermost layer by coating and drying a particulate thermoplastic resin above its glass transition temperature (Tg), but below its minimum film formation temperature (MFFT). Heat treatment of the recording medium after printing renders the outermost layer non-porous or fusion-bonded. EP 0858906 discloses a recording media comprising a base material and a porous surface layer containing particles of a thermoplastic resin, wherein the breadth of the particle size distribution of the particles of the thermoplastic resin is within 3σ, and the proportion of particles having a particle size at most a fifth of the average particle size of the particles of the thermoplastic resin is 10% or lower.

The commonly assigned, co-pending U.S. Ser. No. 10/289,607, filed Nov. 7, 2002 by Yau et al., titled "Inkjet Printing Method" and U.S. Ser. No. 10/289,862, filed Nov. 7, 2002 by Yau et al., titled "Inkjet Recording Element," both hereby incorporated by reference in their entirety, teach the use of high Tg monodisperse particles in combination with a low Tg hydrophobic binder in an ink-receiving layer to provide an inkjet media exhibiting rapid ink absorption. Fusing of such printed media converts the ink-receiving layer to a transparent water-resistant and stain-resistant layer. However, certain problems have been associated with an inkjet recording element in which a single layer of a fusible polymer-particle layer is placed on a substrate. First, poor adhesion of the fused layer to the support may occur and, second, the fused layer may turn hazy or lose gloss appearance with time due to the interaction or incompatibility with components from the applied ink, for example, humectants.

Inkjet recording elements having a multi-layer coating construction above a support are known. For example, EP 0858905, EP 0858906, EP 1160097 A3 (=U.S. 2002008747), EP1188574, JP59222381, U.S. Pat. Nos. 6,114,020, and 6,357,871 all teach a porous ink-transporting topcoat of thermally fusible particles residing on a porous ink-retaining layer. Upon printing, the colorant in the inkjet ink is intended to pass through the topcoat and into an ink-retaining layer. The topcoat layer is then sealed to afford a water and stain resistant print. Such topcoats containing thermally fusible particles typically either contain a binder or are thermally sintered to provide a level of mechanical integrity to the layer prior to the imaging and fusing steps. The porous ink-retaining underlying layer is light diffusive and, therefore, is not suitable for transparency media. In addition, the optical density of the printed image on such multi-layer constructions, coated on a reflective support, is compromised when colorants penetrate into the porous ink-retaining layer.

U.S. Pat. Nos. 4,785,313, 4,832,984, and 6,013,354 disclose recording media comprising a base, an ink-receptive layer that is transparent, and an overcoat layer of fusible fine particles. This type of multi-layer structure has the advantage of being suitable for both transmissive and reflective applications. Both layers are free of light scattering after fusing and, therefore, the image provides higher optical density than the multi-layer construction consisting of a porous ink-retaining layer as described in the previous paragraph. What has been experienced with such media, however, is that the composition of the transparent underlying layer can adversely affect the coating quality of the top fusible layer, the adhesion of the top layer to the substrate, and the image fastness on long-term keeping.

It is an object of this invention to provide a novel porous inkjet recording element that absorbs inks instantly, and after imaging, provides an image which has good quality and is water and abrasion resistant. It is another object of the invention to provide a porous inkjet recording element that is resistant to delamination by customer handling and to image change from long-term keeping.

SUMMARY OF THE INVENTION

These and other objects are achieved in accordance with the invention which comprises an inkjet recording element comprising a support having thereon in sequence (1) a transparent, non-porous layer that can be swelled by water by an amount less than about 0.67 of its original weight, and (2) a fusible, porous, image-receiving layer.

In one preferred embodiment of the invention the fusible, porous layer comprises at least two types of hydrophobic polymer particles having different glass transition temperatures, the first type of hydrophobic polymer particles having a Tg higher than about 60° C. that is substantially monodisperse and the second type of hydrophobic polymer particles having a Tg lower than about 25° C.

By use of the invention, a porous inkjet recording element is obtained that, when printed with an inkjet ink, is "instant" dry to the touch, has good image quality, and after fusing, has satisfactory abrasion and water-resistance, durability and image stability.

Due to the lack of light-scattering matters in the ink-receiving layer after fusing, the elements of the invention are especially suitable for inkjet transparency media and medical imaging media.

DETAILED DESCRIPTION OF THE INVENTION

The transparent, non-porous layer used in the invention comprises a water-soluble polymeric material to provide some swellability to the layer. The layer can thus function to absorb some of the carrier-fluid from the ink-jet ink composition. The layer also comprises one or more other components that limit the swellability of the layer. It has been found that if the layer swells too much, cracks can form above the layer. On the other hand, too little swellability can result in less than good adhesion. In particular, the transparent non-porous layer is swellable by water, but absorbs less than about 0.67 of its weight of deionized water at 25° C. Preferably, the layer can be swelled less than about 0.64 of its original weight in the element. More preferably, the layer can be swelled not more then 0.60. Preferably, the layer can be swelled at least 0.3 of its original weight, more preferably at least 0.35 of its original weight. Swellability can be provided by a water-soluble polymer. In one embodiment, the layer comprises at least 15 percent by weight of the water-soluble polymer, more preferably at least 20 percent by weight.

In one embodiment of the invention, the transparent, non-porous layer comprises a water-soluble polymeric material and water-dispersible polymeric materials. The term "water-soluble" is meant herein to define a material that in solution does not scatter light. The term "water-dispersible" is meant herein to define a material that is not soluble and forms light-scattering particles in water.

Examples of water-soluble polymers that may be used in transparent, non-porous layer include gelatin, partially and fully hydrolyzed poly(vinyl acetate/vinyl alcohol), poly(vinyl pyrrolidone), cellulose ethers, poly(N-vinyl amides), poly (oxazolines), poly(vinylacetamides), polyacrylamides, polyesters, poly(alkylene oxide), poly(acrylic acid), poly(ethyl oxazolines), alginates, gums, poly(methacrylic acid), poly (oxymethylene), poly(ethyleneimine), poly(ethylene glycol methacrylate), poly(hydroxy-ethyl methacrylate), poly(vinyl methyl ether), sulfonated or phosphated polyesters, and polystyrenes, poly(maleic acid), dextrans, starch, whey, albumin, casein, zein, albumin, chitin, chitosan, dextran, pectin, collagen derivatives, collodian, agar-agar, arrowroot, guar, carrageenan, tragacanth, xanthan, rhamsan, and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958). In a preferred embodiment, the water-soluble polymer is gelatin.

In a preferred embodiment, water-dispersible polymers that may be used in the transparent, non-porous layer are latexes or hydrophobic polymers of any composition that can be stabilized in a water-based medium. Such water-dispersible polymers are generally classified as either a condensation polymer or an addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived from them, unsaturated nitrites, vinyl alcohols, acrylamides and methacrylamides, vinyl ketones, multifunctional monomers, and copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers that form water-insoluble homopolymers are preferred, as are copolymers of such monomers. Preferred polymers may also comprise monomers which give water-soluble homopolymers if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. In a preferred embodiment of this invention, the average particle size of the water-dispersible polymer is less than 1 μm, and the glass transition is preferably lower than 25° C. In another preferred embodiment of this invention, the water-dispersible polymer is a polyurethane.

The swell of the transparent layer of this invention can also be controlled by crosslinkers that act upon the binder discussed above. Such crosslinkers may be added in small quantities. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like, and combinations thereof, may be used. Preferably, the crosslinker is a bis(vinylsulfone), aldehyde, an acetal or a ketal, such as 2,3-dihydroxy-1,4-dioxane.

In order to fix colorant and improve image sharpness, especially for water-soluble dyes, an oppositely-charged polymer, complex agent, a dye mordant (for example, a cationic polymeric latex), or agglomerating agent may be added to the transparent non-porous layer. In the case of pigmented inks, the colorant will typically remain in the fusible, porous image-receiving layer, especially if the size of the pigment particles are sufficiently small and the pore size is sufficiently large. If the fusible, porous image-receiving layer is thick enough, even water-soluble dyes will substantially remain in the fusible, porous image-receiving layer. Mordants or other dye-fixing agents may be used in the porous fusible layer or transparent non-porous layer, however, to prevent or limit the dyes from spreading horizontally, which tends to impair or blur the image. It is desirable that the ink colorant substantially remains in the fusible, porous image-receiving layer and substantially not penetrate, or at least not penetrate too much or too far into the transparent, non-porous layer. On the other hand, the carrier liquid, solvents, humectants, or the like can be absorbed by both the transparent non-porous layer and the fusible, porous image-receiving layer.

Additives such as surfactants, viscosity modifiers, matte particles and the like may be added to the transparent non-porous layer to the extent that they do not degrade the properties of interest.

In a preferred embodiment of the invention the fusible, porous layer comprise at least two types of hydrophobic polymer particles having different glass transition temperatures, the first type of hydrophobic polymer particles having a Tg higher than about 60° C. that is substantially monodispersed. In the preferred embodiment, the first type of hydrophobic polymer particles, which are substantially monodispersed, can be prepared, for example, by emulsion polymerization of ethylenically unsaturated monomers with or without surfactants. Any suitable ethylenically unsaturated monomer or mixture of monomers may be used in making monodisperse polymer particles. There may be used, for example, ethylene, propylene,1-butnene, butadiene, styrene, α-methylstyrene, vinyltoluene, t-butylstyrene; mono-ethylenic unsaturated esters of fatty acids (such as vinyl acetate, allyl acetate, vinyl stearate, vinyl pivalate); monoethylenic unsaturated amides of fatty acids (such as N-vinylacetamide, N-vinylpyrrolidone); ethylenic unsaturated mono-carboxylic acid or dicarboxylic acid esters(such as methyl acrylate, ethyl acrylate, propylacrylate, 2-chloroethylacrylate, 2-cyanoethylacrylate, hydroxyethyl acrylate, methyl methacrylate, n-butyl methacrylate, benzyl acrylate, 2-ethylhexyl acrylate, cyclohexyl methacrylate, tetrahydrofurfuryl acrylate, tetrahydrofurfuryl methacrylate, isobornylacrylate, isobornylmethacrylate, n-octyl acrylate, diethyl maleate, diethyl itaconate); ethylenic unsaturated monocarboxylic acid amides (such as acrylamide, t-butylacrylamide, isobutylacrylamide, n-propylacryamide, dimethylacrylamide, methacrylamide, diacetoneacrylamide, acryloylmorpholine); and mixtures thereof. Up to 5% by weight based on total monomer mixture of water-soluble monomers can also be copolymerized to improve particles stability. Examples of preferred water-soluble comonomers are ethylenic unsaturated salts of sulfonate or sulfate (such as sodium acrylamide-2-methylpropane-sulfonate, sodium vinylbenzenesulfonate, potassium vinylbenzylsulfonate, sodium vinylsulfonate); mono-ethylenic unsaturated compounds (such as acrylonitrile, methacrylonitrile), and mono-ethylenic unsaturated carboxylic acid (such as acrylic acid, methacrylic acid, itaconic acid, maleic acid).

If desired, monomers containing a UV absorbing moiety, antioxidant moiety or crosslinking moiety may be used in forming the monodisperse polymer particles in order to improve light fastness of the image or other performance. Examples of UV absorbing monomers that can be used include the following:

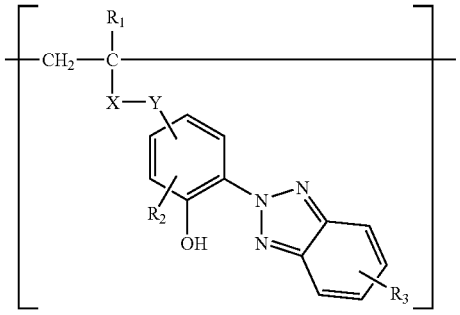

| UV-Absorber | $R_1$ | $R_2$ | $R_3$ | X | Y |
|---|---|---|---|---|---|
| UV-1 | $CH_3$ | H | H | COO | $(CH_2)_2$ |
| UV-2 | H | H | Cl | COO | $(CH_2)_3$ |
| UV-3 | H | H | H | 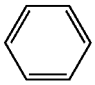 | $CH_2O$ |
| UV-4 | $CH_3$ | $C(CH_3)_3$ | H | COO | $(CH_2)_3$ |
| UV-5 | H | $CH_3$ | H | CONH | $CH_2$ |
| UV-6 | H | $CH_3$ | $OCH_3$ | CONH | $CH_2$ |
| UV-7 | H | $C(CH_3)_3$ | Cl | CONH | $CH_2$ |
| UV-8 | $CH_3$ | H | H | COO | $(CH_2)_2OCONH$ |
| UV-9 | $CH_3$ | Cl | H | COO | $H_2C—CH(OH)—CH_2O$ |
| UV-10 | $CH_3$ | H | Cl | COO | $(CH_2)_3$ |
| UV-11 | H | H | Cl | COO | $(CH_2)_3$ |

-continued

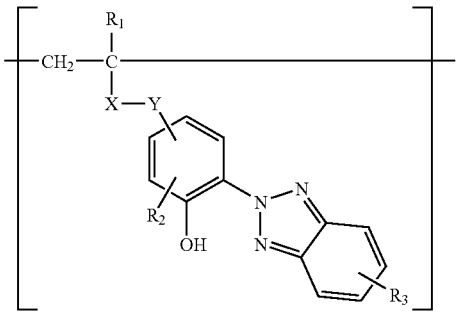

| UV-Absorber | $R_1$ | $R_2$ | $R_3$ | X | Y |
|---|---|---|---|---|---|
| UV-12 | $CH_3$ | H | Cl | COO | $(CH_2)_2—O—C(=O)—(CH_2)_2$ |
| UV-13 | H | H | Cl | COO | $(CH_2)_2—O—C(=O)—(CH_2)_2$ |
| UV-14 | $CH_3$ | H | Cl | COO | $(CH_2)_2—NH—C(=O)—(CH_2)_2$ |
| UV-15 | H | $CH_3$ | H | 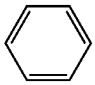 | $CH_2$ |
| UV-16 | H | $CH_3$ | Cl | COO | $(CH_2)_3$ |
| UV-17 | H | $CH_3$ | H | COO | $(CH_2)_2$ |
| UV-18 | $CH_3$ | H | Cl | COO | $(CH_2)_2O$ |
| UV-l9 | H | H | Cl | COO | $(CH_2)_2$ |

Typical crosslinking monomers which can be used in forming the monodisperse polymer particles include aromatic divinyl compounds such as divinylbenzene, divinylnaphthalene or derivatives thereof; diethylene carboxylate esters and amides such as ethylene glycol dimethacrylate, diethylene glycol diacrylate, and other divinyl compounds such as divinyl sulfide or divinyl sulfone compounds. Divinylbenzene and ethylene glycol dimethacrylate are especially preferred.

Examples of a monodisperse polymer particle preparation can be found in "Emulsion Polymerization and Emulsion Polymers", P. A. Lovell and M. S. El-Aasser, John Wiley & Sons, Ltd., 1997, and U.S. Pat. No. 4,415,700, the disclosures of which are hereby incorporated by reference.

The monodisperse polymer particles used in the fusible porous ink-receiving layer of this invention are preferably non-porous. The term "non-porous" is used to define a particle that is either void-free or not permeable to liquids. These particles can have either a smooth or a rough surface.

In the preferred embodiment, a second type of hydrophobic polymer having a Tg of less than 25° C. is used in the fusible, porous ink-receiving layer of the present invention. Such polymer can be a latex or a hydrophobic polymer of any composition that can be stabilized in a water-based medium, such as materials described previously for the water-dispersible polymer used in the transparent layer of this invention.

In a preferred embodiment of the invention, the Tg of the first type of polymer particle used in the fusible porous ink-receiving layer is from about 60° C. to about 140° C. In another embodiment, the Tg of the second hydrophobic polymer used in the fusible, porous ink-receiving layer is from about −60° C. to about 25° C. In still another preferred embodiment, the monodisperse polymer particles used in the fusible, porous ink-receiving layer having a Tg of from about 60° C. to about 140° C. have an average particle size of from about 0.2 μm to about 2 μm. The average particle size is defined as the size (or diameter) that 50% by volume of particles are smaller than.

In yet another preferred embodiment, the monodisperse polymer particles used in the fusible porous ink-receiving layer have a decade ratio of less than about 2, where the decade ratio is an index of monodispersity and is defined as the ratio of the particle size at the $90^{th}$ percentile of the particle size distribution curve to the particle size at the $10^{th}$ percentile. Percentile is defined as the given percent of the volume that is smaller than the indicated size. In yet another preferred embodiment, the weight ratio of the high Tg monodisperse polymer particles to the low Tg hydrophobic polymer in the fusible porous ink-receiving layer is from about 10:1 to about 2.5:1.

After printing on the element employed in the invention, the fusible, porous ink-receiving layer is heat and/or pressure fused to form a substantially continuous, transparent layer on the surface. Upon fusing, this layer is rendered non-light scattering. Fusing may be accomplished in any manner which is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference.

In a preferred embodiment, fusing is accomplished by contacting the surface of the element with a heat-fusing member, such as a fusing roller or fusing belt. Thus, for example, fusing can be accomplished by passing the element through a pair of heated rollers, heated to a temperature of about 60° C. to about 160° C., using a pressure of 5 to about 15 MPa at a transport rate of about 0.005 m/sec to about 0.5 m/sec.

The image-receiving layer may also contain additives such as pH-modifiers, rheology modifiers, surfactants, UV-absorbers, biocides, lubricants, waxes, dyes, optical brighteners, etc.

The image-receiving layer may be applied to one or both substrate surfaces through conventional pre-metered or post-metered coating methods such as blade, air knife, rod, roll, slot die, curtain, slide, etc. The choice of coating process would be determined from the economics of the operation and in turn, would determine the formulation specifications such as coating solids, coating viscosity, and coating speed.

The transparent, non-porous layer of this invention may range from 2 μm to 20 μm, preferably 5 to 15 μm. The fusible, porous image-receiving layer thickness before fusing may range from about 10 to about 100 μm, preferably from about 20 to about 70 μm. The coating thickness required is determined through the need for the coating to act as a sump for absorption of ink solvent. In general, the image-receiving layer is coated in an amount of from about 10 g/m$^2$ to about 60 g/m$^2$. Further, the pore volume of the fusible, porous, image-receiving layer in general is from about 5 to about 50 ml/m$^2$.

The support used in the inkjet recording element of the invention may be opaque, translucent, or transparent. There may be used, for example, plain papers, resin-coated papers, laminated paper, such as those described in U.S. Pat. Nos. 5,853,965; 5,866,282; 5,874,205; 5,888,643; 5,888,681; 5,888,683; and 5,888,714, various plastics including a polyester resin such as poly(ethylene terephthalate), poly(ethylene naphthalate) and poly(ester diacetate); cellulosics, such as cellulose acetate, cellulose diacetate, and cellulose triacetate; a polycarbonate resin; a fluorine resin such as poly (tetra-fluoro ethylene); metal foil; various glass materials; and the like. The support may also be void-containing polyolefin, polyester, or membrane. Examples of void-containing polyester preparation can be found in U.S. Pat. Nos. 5,354,601 and 6,379,780. A voided membrane can be formed in accordance with the known technique of phase inversion. The thickness of the support employed in the invention can be from about 12 to about 500 μm, preferably from about 75 to about 300 μm.

Another aspect of the present invention relates to an a inkjet printing method, comprising the steps of:

A) providing an inkjet printer that is responsive to digital data signals;

B) loading said printer with the inkjet recording element, as described above, comprising a fusible, porous image-receiving layer and a transparent, non-porous layer between the support and the fusible layer which can be swelled by water by an amount less than about 0.67 of its original weight;

C) loading said printer with an inkjet ink;

D) printing on the inkjet recording element using said inkjet ink in response to said digital data signals; and E) fusing the fusible, porous image-receiving layer.

Preferably, the method comprises the use of pigmented inkjet inks and preferably, the pigmented inks are such that they are retained in the image-receiving layer after being applied to the element.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

During the inkjet printing process, ink droplets are rapidly absorbed into the porous layer through capillary action and the image is dry-to-touch right after it comes out of the printer. Therefore, the porous layer allows a fast "drying" of the ink and produces a smear-resistant image.

Since the image recording element may come in contact with other image recording articles or the drive or transport mechanisms of image recording devices, additives such as surfactants, lubricants, matte particles, and the like may be added to the element to the extent that they do not degrade the properties of interest.

Inkjet inks used to image the recording elements of the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758; the disclosures of which are hereby incorporated by reference.

The following examples are provided to illustrate the invention.

EXAMPLES

Characterization of Polymer Particles

Glass Transition Temperature—The Tg of the dry polymer materials was determined by differential scanning calorimetry (DSC), using a heating rate of 20° C./minute. Tg is defined herein as the inflection point of the glass transition.

Particle Size Measurement—Polymer particles were characterized by an Ultrafine® Particle Analyzer (UPA) manufactured by Leeds & Northrup. Two forms of a graph for presenting particle size data are obtained: the histogram and the cumulative plot. Percentile points show the given percent of the volume that is smaller than the indicated size. The 50% is used as the "average particle size." The decade ratio is defined as the ratio of particle size at the 90$^{th}$ percentile point to the particle size at the 10$^{th}$ percentile point. The smaller the decade ratio, the narrower the particle size distribution.

Preparation of Monodisperse Polymer Particle P-1

A 12-liter, Morton reaction flask was prepared by adding 2000 g of demineralized water. The flask contents were heated to 80° C. with 150 RPM stirring in a nitrogen atmosphere. A first aqueous phase addition flask was made up with 1987 g of demineralized water and 13.2 g of sodium metabisulfite. A second aqueous phase addition flask was made up with 1973 g of demineralized water and 26.4 g of sodium persulfate. A monomer phase addition flask was prepared by adding 2418.7 g of ethyl methacrylate and 127.3 g of methyl methacrylate. Then, charges to the reaction flask from each addition flask were started at 5 g per minute. The addition flasks were recharged as needed. Samples were taken at various times and the monomer phase feed was stopped when the desired latex particle size was reached. The charges of the redox initiator solutions were extended for 30 minutes beyond the end of the monomer phase addition to chase residual monomers. The reaction flask contents were stirred at 80° C. for one hour followed by cooling to 20° C., and filtration through 200 μm polycloth material. The latex was concentrated to 50% solids by ultrafiltration.

P-1 has a Tg of 80° C., average particle size of 753 nm and a decade ratio of 1.322.

Low Tg Particle Dispersion P-2

P-2 is a polyurethane dispersion Witcobond W-320® (CK Witco Corporation; Sistersville, W. Va.). The dispersion is nonionic, thus is compatible with anionic or cationic polymer particle dispersions. The average particle size of the dispersion is 3 μm, and the Tg is −12° C., both quoted from CK Witco Corporation.

Low Tg Particle Dispersion P-3

P-3 is a polyurethane dispersion Witcobond W-213® (CK Witco Corporation). The dispersion is cationic, thus is compatible with cationic monodisperse polymer particle P-1. The average particle size of the dispersion is 33.7 nm as measured by UPA, and the Tg is −27.5° C.

Aqueous Wax Emulsion W-1

W-1 is an aqueous wax emulsion of modified silicone fluid GP-50-A (Genesee Polymers Corporation; Flint, Michigan).

Dye Mordant M-1

M-1 is a cationic polymer latex of (vinylbenzyl)trimethylammonium chloride and divinylbenzene (87:13 molar ratio) in composition.

Gelatin-1

Gelatin-1 is type 4 (bone) TCG-III class 30 gelatin available from Eastman Gel, a division of Eastman Kodak Company; Rochester, N.Y.

Gelatin-2

Gelatin-2 is type 5 (pigskin) deionized gelatin code 55 available from KIND & KNOX, Johnstown, N.Y.

PVA

PVA is a poly(vinyl alcohol), trade name GH-23 available from Nippon Synthetic Chemical Industry Co., Ltd. (Nippon Gohsei), Japan.

Preparation of Control Element A

An inkjet media containing fusible, porous image-receiving layer was prepared by coating an aqueous solution comprising particles P-1, P-2 and W-1 onto 180 μm (7 mil) thick bi-axially oriented polyethylene terephthalate film support that had been subbed with 0.1 μm thick of a terpolymer latex of acrylonitrile, vinylidene chloride, and acrylic acid, and then 0.1 μm thick of gelatin. The concentrations of P-1, P-2 and W-1 were 37.5%, 7.19% and 0.31% by weight respectively. A nonionic surfactant, Zonyl FSN® (DuPont; Wilmington, Del.), in the amount 0.25%, was used in the coating solution to control the surface tension during coating. The coating solution was laid down at 87.1 cc/m$^2$ (8 cc/ft$^2$), and dried at 21° C. for 10 minutes with forced air circulation.

Preparation of Elements 1-12

Elements 1-12 were prepared similarly to Control Element A, except a transparent, non-porous layer was coated on the film support and dried before the fusible, porous image-receiving layer was coated on top of it. Each coating solution for the transparent layer was laid down at 87.1 cc/m$^2$ (8 cc/ft$^2$), dried for 2 minutes at 49° C. followed by 6 minutes at 25° C. with forced air circulation. A nonionic surfactant Olin 10G® (0.075%) was used in the coating solution to control the surface tension during coating. The fusible, porous layer was coated on top of transparent layer by the same procedure as described in the previous paragraph for "Preparation of Control Element A" within 2 hours after the transparent layer was coated.

The composition of transparent layer and fusible porous layer for elements 1 to 12 and Control A are summarized in Table 1. The components are listed in mg/ft$^2$.

TABLE 1

| Element | Transparent Bottom layer (Laydown in mg/ft$^2$) | Fusible, Porous Top Layer (Laydown in mg/ft$^2$) |
|---|---|---|
| Control A | None | 3000 P-1<br>575 P-2<br>25 W-1 |
| C-1 | 250 Gelatin-1<br>100 M-1<br>450 P-3<br>6 bis(vinyl sulfonylmethane) | Same as Control A |
| 2 | 225 Gelatin-1<br>100 M-1<br>475 P-3<br>6 bis(vinyl sulfonylmethane) | Same as Control A |
| 3 | 200 Gelatin-1<br>100 M-1<br>500 P-3<br>6 bis(vinyl sulfonylmethane) | Same as Control A |
| 4 | 200 Gelatin-1<br>100 M-1<br>500 P-3<br>10 bis(vinyl sulfonylmethane) | Same as C-1 |
| 5 | 200 Gelatin-2<br>100 M-1<br>500 P-3<br>10 bis(vinyl sulfonylmethane) | Same as Control A |
| C-6 | 300 Gelatin-2<br>500 P-3<br>6 bis(vinyl sulfonylmethane) | Same as Control A |
| C-7 | 250 Gelatin-2<br>550 P-3<br>6 bis(vinyl sulfonylmethane) | Same as Control A |
| 8 | 200 Gelatin-2<br>500 P-3<br>6 bis(vinyl sulfonylmethane) | Same as Control A |
| C-9 | 400 Gelatin-1<br>600 P-3<br>6 bis(vinyl sulfonylmethane) | Same as Control A |
| C-10 | 350 Gelatin-1<br>650 P-3<br>6 bis(vinyl sulfonylmethane) | Same as Control A |
| 11 | 300 Gelatin-1<br>700 P-3<br>6 bis(vinyl sulfonylmethane) | Same as Control A |
| 12 | 250 Gelatin-1<br>750 P-3<br>6 bis(vinyl sulfonylmethane) | Same as Control A |
| C-13 | 250 Gelatin-1<br>125 M-1<br>625 P-3<br>7.5 bis(vinyl sulfonylmethane) | Same as Control A |
| C-14 | 600 PVA<br>100 M-1<br>100 P-2<br>60 2,3-Dihydroxydioxane | Same as Control A |
| C-15 | 400 PVA<br>100 M-1<br>300 P-2<br>40 2,3-Dihydroxydioxane | Same as Control A |

Swell Measurement of Transparent Bottom Layer

The transparent bottom layer was coated and kept in the 0° F. freezer till the swell measurement. Swell measurement was carried out by immersing the coating in 25° C. in de-ionized water for 4 minutes, and the increase in thickness of the transparent bottom layer was recorded. The increase in thickness was converted to weight of water absorbed by the transparent bottom layer, based on density of 1.0 for water. Swell is defined as the weight of water absorbed ratio to the weight of the transparent bottom layer.

Coating Quality

Coating quality of each element was inspected by naked eye with a 7× magnifier. An element was considered good if no cracks were observed, and poor if any cracks were observed.

Inkjet Printing

All elements were loaded into an Epson® Stylus Photo 820 printer with color ink cartridge T027 and black ink cartridge T026, and printed with a pre-assembled digital image of color patches and pictures. The printed sample was immediately rubbed by a finger on heavily inked areas as it was ejected from the printer. "Instant dry" is defined as the print was dry to the touch and the image was not smudged or damaged by the finger-rubbing action. If the particles coalesced and formed a continuous film on drying after coating, the ink would form droplets on the surface and not penetrate through the layer. Therefore, such an image would be low in optical density and easily smudged by rubbing.

Drying and Fusing

The printed elements were air-dried in room condition for 16 hours and then fused between a set of heated pressurized rollers, at least one of which was heated at a temperature of 150° C. and a speed of 2.5 cm per second.

Image Quality

The elements were examined visually and rated according to the following:

Good=No smearing

Fair=Some smearing

Poor=Severe smearing

Mandrel Test for Adhesion

The fused element was wrapped around a mandrel of 6.16 mm in diameter with the image receiving side facing away from the mandrel. The curled area was examined for damage according to the following:

Good=No damage

Fair=slight haze observed

Poor=fused layer delaminated off support

The evaluation results are summarized in Table 2 below.

TABLE 2

| Element | Swell of bottom layer | Coating Quality | Instant-Dry after printing | Image quality | Adhesion |
|---|---|---|---|---|---|
| Control A | Not applicable | Good | Yes | Good | Poor |
| C-1 | 0.816 | Poor | Yes | Good | Fair |
| 2 | 0.583 | Good | Yes | Good | Fair |
| 3 | 0.408 | Good | Yes | Good | Fair |
| 4 | 0.496 | Good | Yes | Good | Fair |
| 5 | 0.408 | Good | Yes | Good | Fair |
| C-6 | 1.166 | Poor | Yes | Good | Fair |
| C-7 | 0.700 | Poor | Yes | Good | Fair |
| 8 | 0.554 | Good | Yes | Good | Fair |
| C-9 | 0.840 | Poor | Yes | Good | Fair |
| C-10 | 0.676 | Poor | Yes | Good | Fair |
| 11 | 0.536 | Good | Yes | Good | Fair |
| 12 | 0.490 | Good | Yes | Good | Fair |
| C-13 | 0.793 | Poor | Yes | Good | Fair |
| C-14 | 1.195 | Poor | Yes | Good | Fair |
| C-15 | 1.166 | Poor | Yes | Good | Fair |

The above results show that the transparent bottom layer in general provides improvement in adhesion while maintaining the same fast ink-absorption characteristic and image quality. However, there is some degraded coating quality of the fusible layer if it swelled an amount equal to or greater than 0.67.

Although the invention has been described in detail with reference to certain preferred embodiments for the purpose of illustration, it is to be understood that variations and modifications can be made by those skilled in the art without departing from the spirit and scope of the invention.

The invention claimed is:

1. An inkjet recording element comprising, above a support, the following layers in order:

(a) a transparent, non-porous layer comprising at least 15 weight percent of gelatin, which layer is swellable by water in an amount less than 0.67 of its original weight, wherein the transparent, non-porous layer comprises a crosslinking agent for the gelatin; and (b) a fusible, porous image-receiving layer, wherein the fusible, porous image-receiving layer comprises at least two types of hydrophobic polymer particles having different glass transition temperatures, a first type of hydrophobic polymer particles having a Tg higher than 60° C. that is substantially monodisperse and a second type of hydrophobic polymer particles having a Tg lower than about 25° C.

2. The element of claim 1 wherein the transparent, non-porous layer comprises at least 20 weight percent of gelatin.

3. The element of claim 1 wherein the first type of hydrophobic polymer particles which is substantially monodisperse has an average particle size of from about 0.2 μm to about 2 μm, and has a particle size distribution such that the ratio of the particle size at the $90^{th}$ percentile of the particle size distribution curve to the particle size at the $10^{th}$ percentile of the particle size distribution curve is less than about 2.

4. The element of claim 1 wherein the first type of hydrophobic polymer particles which is substantially monodisperse has a Tg of from about 60° C. to about 140° C.

5. The element of claim 1 wherein the second type of hydrophobic polymer particles has a Tg of from about −60° C. to about 25° C.

6. The element of claim 1 wherein the weight ratio of the first type of hydrophobic polymer particles to the second type of hydrophobic polymer particles is from about 10:1 to about 2.5:1.

7. The element of claim 1 wherein the fusible, porous image-receiving layer is coated in an amount of from about 10 $g/m^2$ to about 60 $g/m^2$.

8. The element of claim 1 wherein the transparent, non-porous layer further comprises water-dispersible polymer.

9. The element of claim 1 wherein the transparent, non-porous layer is from 2 μm to 20 μm thick.

10. The element of claim 8 wherein the water-dispersible polymer has a Tg lower than 25° C.

11. The element of claim 8 wherein the water-dispersible polymer has an average particle size of less than 1 μm.

12. The element of claim 8 wherein the water-dispersible polymer is polyurethane.

13. The element of claim 1 wherein the support is resin-coated paper or a transparent polymer film.

14. The element of claim 1 wherein the fusible, porous image-receiving layer is crosslinked.

15. The element of claim 1 wherein the fusible, porous image-receiving layer contains an ultraviolet absorbing agent.

16. The element of claim 1 wherein pore volume of the fusible, porous image-receiving layer is from about 5 to about 50 $ml/m^2$.

17. An inkjet recording element comprising, above a support, the following layers in order:

(a) a transparent, non-porous layer, having a thickness of 2 to 15 μm, that is swellable by water in an amount 0.3 to less than 0.67 of its original weight and which comprises both a water-soluble polymer and a water-dispersible polymer; and (b) a fusible, porous image-receiving layer, having a thickness of 20 to 70 μm, wherein the fusible, porous image-receiving layer is capable of fusing when heated to a temperature of 60 to 160° C. and comprises at least two types of hydrophobic polymer particles having different glass transition temperatures, a first type of hydrophobic polymer particles having an average particle size of from about 0.2 μm to about 2 μm and a Tg of from 60° to 160° C. and a second type of hydrophobic polymer particles having a Tg lower than about 25° C., wherein the weight ratio of the first type of hydrophobic polymer particles to the second type of hydrophobic polymer particles is from about 10:1 to about 2.5:1.

18. The element of claim 17 wherein the transparent, non-porous layer further comprises a crosslinking agent for the water-soluble polymer.

19. The element of claim 17 wherein the transparent, non-porous layer further comprises a dye fixing agent.

20. An inkjet printing method, comprising the steps of:

A) providing an inkjet printer that is responsive to digital data signals;

B) loading the printer with the inkjet recording element of claim 1;

C) loading the printer with inkjet inks;

D) printing on the inkjet recording element using the inkjet inks in response to the digital data signals; and E) fusing the fusible, porous image-receiving layer.

21. The method of claim 20 wherein the inkjet inks comprise pigmented inks that are substantially retained in the fusible, porous image-receiving layer.

* * * * *